US007987967B2

(12) United States Patent
Abraham et al.

(10) Patent No.: US 7,987,967 B2
(45) Date of Patent: Aug. 2, 2011

(54) DEFORMABLE-WHEEL CONVEYOR EXERTING A PROGRESSIVE PINCHING FORCE

(75) Inventors: Daniel Abraham, Soyons (FR); Robert Vivant, Chabeuil (FR); Stephane Ambroise, Tain L'Hermitage (FR); Pierre Chorier-Pichon, Romans (FR)

(73) Assignee: Solystic, Gentilly Cedex (FR)

( * ) Notice: Subject to any disclaimer, the term of this patent is extended or adjusted under 35 U.S.C. 154(b) by 202 days.

(21) Appl. No.: 12/298,241

(22) PCT Filed: Jul. 17, 2008

(86) PCT No.: PCT/FR2008/051343

§ 371 (c)(1),
(2), (4) Date: Oct. 23, 2008

(87) PCT Pub. No.: WO2009/019386

PCT Pub. Date: Feb. 12, 2009

(65) Prior Publication Data

US 2010/0170770 A1 Jul. 8, 2010

(30) Foreign Application Priority Data

Aug. 2, 2007 (FR) ..... 07 56893

(51) Int. Cl.
*B65G 29/00* (2006.01)

(52) U.S. Cl. ..... 198/624; 198/608

(58) Field of Classification Search ..... 198/604, 198/608, 610, 620, 624
See application file for complete search history.

(56) References Cited

U.S. PATENT DOCUMENTS

| | | | | | |
|---|---|---|---|---|---|
| 3,911,799 | A | * | 10/1975 | Klund | 198/624 |
| 4,765,273 | A | * | 8/1988 | Anderle | 198/624 |
| 4,875,670 | A | * | 10/1989 | Petersen et al. | 198/624 |
| 5,133,445 | A | * | 7/1992 | Spatafora et al. | 198/624 |
| 5,228,553 | A | * | 7/1993 | Herrmann | 198/624 |
| 6,253,813 | B1 | * | 7/2001 | Kube et al. | 198/624 |

FOREIGN PATENT DOCUMENTS

| | | | |
|---|---|---|---|
| EP | 0 386 278 | A | 9/1990 |
| FR | 2 692 565 | A | 12/1993 |
| JP | 58-47742 | A | 3/1983 |
| WO | WO 00/78471 | A1 | 12/2000 |

* cited by examiner

*Primary Examiner* — James R Bidwell
(74) *Attorney, Agent, or Firm* — Rothwell, Figg, Ernst & Manbeck, P.C.

(57) ABSTRACT

A conveyor device for conveying flat objects on edge, which device comprises at least two wheels having elastically deformable treads and disposed facing each other so as to move a flat object on edge by pinching and friction. The two wheels are arranged in such a manner as to exert a pinching force on the flat object on edge that varies progressively as the flat object is driven forwards.

8 Claims, 1 Drawing Sheet

DEFORMABLE-WHEEL CONVEYOR EXERTING A PROGRESSIVE PINCHING FORCE

CROSS-REFERENCE TO RELATED APPLICATIONS

This application is a 35 U.S.C. §371 National Phase Application from PCT/FR2008/051343, filed Jul. 17, 2008, and designating the United States, which claims the benefit of France Patent Application No. 0756893, filed Aug. 2, 2007.

BACKGROUND OF THE INVENTION

1. Field of the Invention

The invention relates to a conveyor device for conveying flat objects, which device comprises at least one pair of wheels having elastically deformable treads and disposed facing each other so as move a flat object by pinching and by friction.

The invention relates more particularly to a conveyor device suitable for moving a broad spectrum of flat mailpieces ranging from coupons of very small thickness (of about 0.5 millimeters (mm)) to flat mailpieces or "flats" of large format and of very large thickness (of about 30 mm).

2. Discussion of the Background Art

European Patent Document EP-1 194 249 discloses such a conveyor device that is part of a more complex system that can be referred to as a "synchronizer" in a mail sorting machine.

That synchronizer comprises a plurality of stages, each of which has two levels of motor-driven coupled wheels rotating at a speed that is controlled so as to synchronize the movement of a mailpiece (inserted between the facing coupled wheels) with the movement of a bin of a bin carrousel, into which bin said mailpiece is to be injected. In that known arrangement, each current mailpiece is pushed between the wheels of the inlet stage of the synchronizer by an unstacker member that is, in the example described, a perforated belt moving past a suction nozzle.

The synchronizer is controlled in a manner that takes account of the instant at which the current mailpiece goes past a sensor placed at the inlet of the synchronizer and of the instant at which a bin (into which the mailpiece is to be injected) goes past another sensor placed along the path along which the bins travel.

On the basis of a relatively constant speed of movement of the mailpiece between the outlet from the synchronizer and the point of injection into a bin, an acceleration curve is computed for the speed of the mailpiece in the synchronizer so as to make the passage of the bin coincide with the arrival of the mailpiece. In practice, at the outlet from the synchronizer, the mailpieces follow one another in series with constant spacing between their leading edges that corresponds to the spacing between four consecutive bins of the carrousel.

In that synchronizer, the inlet stage is made up of at least two facing wheels with elastically deformable treads that are of the same diameter. The two wheels are in contact with each other via the outside surfaces of their treads.

When a mailpiece is inserted on edge between the facing wheels of the inlet stage, the leading edge of said mailpiece deforms the treads of the facing wheels substantially on the line of contact of the treads. By being pushed back, the treads of the facing wheels exert a pinching force on the opposite surfaces of the mailpiece, that pinching force being distributed over almost the entire height of the mailpiece. Once the mailpiece is fully engaged between the two opposite wheels of the inlet stage, it is driven (with a certain amount of acceleration) by friction towards the wheels of the second stage and so on to the outlet from the synchronizer.

It has been observed that, for the thickest mailpieces, for which the treads deform to the largest extent, the insertion time required for inserting such mailpieces between the wheels of the inlet stage is also longer than for thinner mailpieces because such thick mailpieces take more time to pass through the synchronizer than such thinner mailpieces. Since the spacing between two consecutive mailpieces should be constant (or equal to a multiple of the constant spacing value), it has been observed that the synchronizer as described above delays the instant at which some of the thickest mailpieces are injected, e.g. by doubling or tripling the spacing between them and the mailpieces preceding them. That therefore affects the throughput of the mail sorting machine.

SUMMARY OF THE INVENTION

An object of the invention is to mitigate that drawback.

To this end, the invention provides a conveyor device for conveying flat objects on edge, which device comprises two axles, on each of which at least two wheels having elastically deformable treads are disposed symmetrically facing each other so as to move a flat object on edge by pinching and friction, said conveyor device being characterized in that the two wheels are arranged in such a manner as to exert a pinching force on the flat object on edge that varies progressively in the height direction as the flat object is driven forwards.

This progressive pinching force can be obtained, in accordance with the invention, by arranging the wheels in such a manner as to form a substantially V-shaped pinching gap between the treads. For this purpose, the facing wheels can be mounted on axles that are inclined at in the range 5° to 10°.

It is also possible to arrange the wheels in such a manner as to form a pinching gap that varies substantially stepwise between the treads. For this purpose, in accordance with the invention, each tread is made up of a plurality of rings of different diameters. There are therefore a plurality of superposed treads that may or may not be parts of as many different superposed wheels. It is possible to put spacers between adjacent superposed wheels in order to separate them or on the contrary to superpose them without spacers and, in addition, to stiffen them with axial rods distributed around the peripheries of the hubs of the wheels so as to limit wobble of the treads while the wheels are rotating at very high speeds.

These two configurations of facing wheels contribute to obtaining an insertion time for inserting mailpieces of large thickness between the wheels of the inlet stage of the synchronizer that is almost identical to the insertion time for mailpieces of smaller thickness.

The invention can be applied to a synchronizer-conveyor in which facing wheels are disposed in one or more superposed layers as they are in the synchronizer-conveyor described in Patent EP-1 194 249.

Naturally, the principle of the invention can be applied to any conveyor having elastically deformable wheels that is adapted to move flat objects by pinching and friction.

BRIEF DESCRIPTION OF THE DRAWINGS

A conveyor device of the invention is described below with reference to the drawing, in which.

DETAILED DESCRIPTION OF THE PREFERRED EMBODIMENTS

Figure 1:
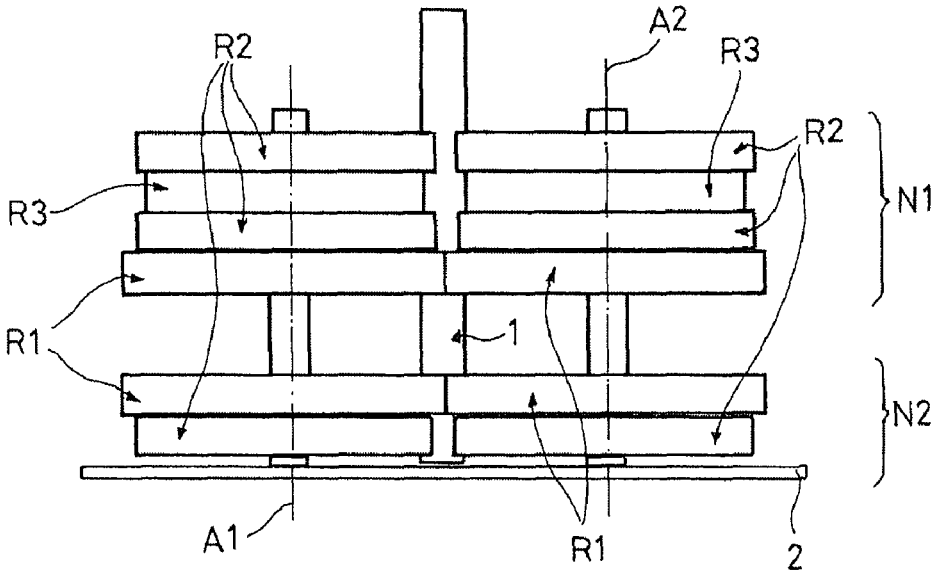
FIG. 1 shows a wheel configuration with a pinching gap that varies substantially stepwise.

FIG. 1 shows elastically deformable wheels mounted facing one another in pairs on two parallel axles A1, A2, and a flat object that is on edge, e.g. a flat mailpiece 1 on edge.

The two axles A1, A2 are mounted to rotate on a plate 2 that constitutes the bed of a conveyor that can be part of a mailpiece unstacker device in a mail sorting machine.

FIG. 1 shows two levels N1 and N2 of motor-driven facing wheels. R1 designates first elastically deformable wheels having treads of diameter that is, for example, about 150 mm. R2 designates second elastically deformable wheels having treads of diameter of about 140 mm. R3 designates third elastically deformable wheels having treads of diameter of about 130 mm.

The wheels R1, R2, and R3 are disposed symmetrically, facing one another in pairs on the two axles A1 and A2. Level N1 comprises the following wheels in superposition, from the bottom upwards: R1, R2, R3, and R2. Level N2 comprises the following wheels in superposition: R2 and R1. In both levels N1 and N2, the wheels thus define pinching gaps that vary stepwise in the height direction.

By being inserted (in a direction perpendicular to the plane of the drawing), the mailpiece 1 is pinched firstly between the facing wheels R1 that are pushed back on either side of the mailpiece, then between the wheels R2 that are of smaller diameter than the wheels R1, and finally between the wheels R3 that are of smaller diameter than the wheels R2.

Thus, the total pinching force that is exerted on the faces of the mailpiece varies progressively over time as the mailpiece penetrates between the different-diameter facing wheels.

In the example of mail sorting, each wheel has a tread of height of about 15 mm that is connected to a hub by inclined flexible fins. It is possible for the wheels R1, R2, R3 to have different levels of stiffness (against deformation) or for the wheels on one axle to have the same level of stiffness, but for the level of stiffness to differ from the level of stiffness of the wheels situated on the other axle.

Figure 2:
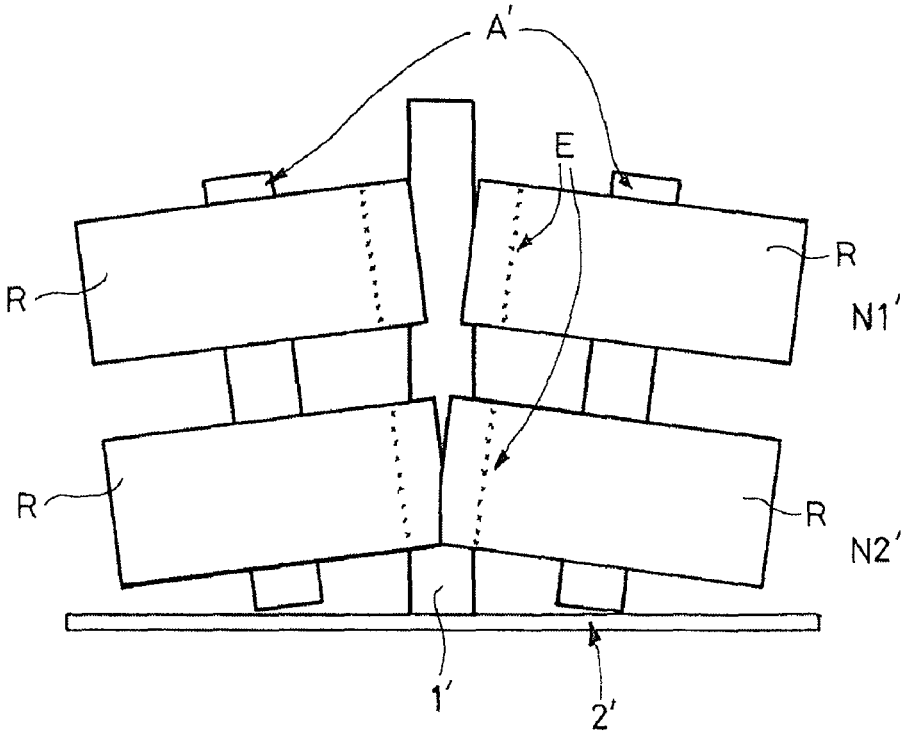
FIG. 2 shows a wheel configuration with a pinching gap that is substantially V-shaped.

FIG. 2 shows a wheel configuration in which the treads define a V-shaped pinching gap. In this example, the axles A' are inclined relative to each other on the plate 2' and each of them carries two levels N1' and N2' of wheels R. In this example, the wheels R are of identical diameter.

While the mailpiece 1' is advancing (perpendicularly to the plane of the drawing) between the two inclined axles, its edge is pinched progressively, as it advances, between the treads of the wheels R of the level N2' (the lower level), and then between the treads of the wheels R of the level N1' (the lines E represent the points of contact between the mailpiece and the wheels R).

Naturally, it is possible to combine inclined axles, as shown in FIG. 2, with wheels of different diameters, as shown in FIG. 2, without going beyond the ambit of the invention.

The invention claimed is:

1. A conveyor device for conveying flat objects on edge, which device comprises two axles and at least two wheels having elastically deformable cylindrical treads that are disposed symmetrically facing each other on the two axles so as to move a flat object on edge by pinching and friction, wherein the at least two wheels comprise at least two corresponding levels in superposition, each level being arranged in such a manner as for the wheels to define pinching gaps that vary stepwise in the height direction between levels to exert a pinching force on the flat object on edge that varies progressively in the height direction as the flat object is driven forwards.

2. A device according to claim 1, in which said wheels are arranged in such a manner as to form a substantially V-shaped pinching gap between the treads.

3. A device according to claim 1, in which said wheels are arranged in such a manner as to form a pinching gap that varies substantially stepwise between the treads.

4. A synchronizer-conveyor for mailpieces, including a conveyor device according to claim 1.

5. A device according to claim 1, in which said wheels of a same level have the same diameter.

6. A device according to claim 1, in which said axles are inclined.

7. A device according to claim 1, in which at least two wheels with cylindrical treads are disposed on each axle.

8. A conveyor device for conveying flat objects on edge, which device comprises two axles and at least two wheels having elastically deformable treads that are disposed symmetrically facing each other on the two axles so as to move a flat object on edge by pinching and friction, wherein the two wheels are arranged in such a manner as to exert a pinching force on the flat object on edge that varies progressively in the height direction as the flat object is driven forwards, in which said wheels are arranged in such a manner as to form a pinching gap that varies substantially stepwise between the treads, and in which each tread is made up of a plurality of rings of different diameters.

* * * * *